United States Patent [19]

Skalka

[11] 4,113,312

[45] Sep. 12, 1978

[54] BENCH

[75] Inventor: Gerald P. Skalka, Potomac, Md.

[73] Assignee: Victor Stanley, Inc., Dunkirk, Md.

[21] Appl. No.: 873,976

[22] Filed: Jan. 31, 1978

[51] Int. Cl.[2] ..... A47C 7/02

[52] U.S. Cl. ..... 297/454; 297/444; 297/445

[58] Field of Search ..... 297/445, 452, 454, 440, 297/444

[56] References Cited

U.S. PATENT DOCUMENTS

| | | | |
|---|---|---|---|
| 369,829 | 9/1887 | Winkler | 297/454 |
| 872,736 | 12/1907 | Lansberry | 297/454 X |
| 1,886,308 | 11/1932 | Schultes | 297/454 X |

*Primary Examiner*—James C. Mitchell

*Attorney, Agent, or Firm*—Mason, Fenwick & Lawrence

[57] ABSTRACT

A bench has transversely spaced metal frames supporting elongated wooden slats of metal angle members formed of two perpendicular metal plates; a bolt passes through one plate and an opening in the frame for attachment to the frame with a recess in each slat fitting over the head of the bolt and screws extending through screw openings in both plates to hold the slats in position.

10 Claims, 3 Drawing Figures

BENCH

This invention is in the field of furniture items and is more specifically directed to the field of outdoor furniture devices such as benches or chairs. Even more specifically, the subject invention in its preferred embodiment is directed to a rugged type bench construction of particular use in public installations such as parks or the like in which the device is subjected to unusually vigorous and sometimes abusive treatment.

Park benches and the like used in places of public accommodation must be of substantially greater strength and durability than is required or normal outdoor type yard furniture. Moreover, achievement of the required strength and durability must be balanced against the cost factor in order to provide a commercially feasible construction.

Prior known bench devices have employed a metal framework to which a plurality of wooden slats have been attached in a variety of ways. For example, the wooden slats have been attached to the metal framework by the use of a bolt extending all the way through drilled openings in the framework and the slats or by the use of screw means extending through openings in the metal framework and embedded in the body of the slats. Constructions of the foregoing type require a substantial amount of labor in assembly and do not always provide satisfactory functional results due to the eventual loosening of the slat members on the supporting metal framework as occurs with the passage of time and the normal shrinking and swelling of wood.

Additionally, in some constructions the bolt heads of the bolts attaching the slats to the framework extend above the surface of the slat members to result in some discomfort to users. While the last-mentioned problem can be overcome to a certain extent by countersinking the bolt heads in the upper surface of the slats, such a procedure increases the labor and assembly costs and also creates a depression which will catch and hold rain water which will eventually result in deterioration of the wood of the slat in the area around the bolt.

Other slat constructions employ channel members attached to a supporting metal framework with the channel members being of U-shaped cross-sectional configuration for receiving the individual slat members. A construction of the last-mentioned type required that the slat elements be precisely and snugly fitted within the channel members in position between the side flanges of the channel members. A particular disadvantage of the foregoing type construction is that any shrinking of the wood may well result in substantial loosening of the attachment of the slat to the channel member while any swelling of the wood may result in a warping or splitting of the slat as a result of the internal stress exerted on the slat.

Another conventional bench construction employed with curved benches requires the use of spacer elements between the adjacent slats with a threaded curved rod extending through all of the slats and the spacer element to hold the slat and spacer components in position. This construction tends to become loose with shrinkage of the wood and is also expensive to fabricate due to the substantial amount of labor required in the fabrication process. It should also be noted that the shrinkage of the wood slats in many of the prior known wood-metal constructions is a substantial problem which can result in the loosening of the slat components on the supporting framework in a variety of detrimental ways.

The eventual cost of a bench to a user can be reduced by reducing the shipping charges and by permitting the user to make the final assembly of the bench components. One way in which the shipping charges can be lowered is by reducing the total volume required for the bench components during the shipping operation and this is most easily effected if all of the components can be completely disassembled while having the capability of being easily assembled by the user; such has not been the case with most of the prior known constructions.

Another disadvantage of prior known bench constructions is that they employ different types of connections for the slats attached to the metal framework in different portions of the bench. This increases the overall cost of the construction. Yet another problem with some of the prior known constructions is that the supporting or attaching means for the wooden slats extends beyond the front slat of the seat portion of the bench and can be engaged by the leg of the user in an uncomfortable manner or to snag clothing.

Therefore, it is the primary object of this invention to provide a new and improved bench construction.

A further object of the invention is the provision of a new and improved bench construction that is economical and easy to fabricate.

Yet another object of the invention is the provision of a new and improved bench construction employing improved means for fastening wooden slats to a supporting framework.

Another object of the invention is the provision of a new and improved bench construction that is economical and easy to fabricate and is substantially stronger than conventional bench assemblies.

A still further object of the invention is the provision of a new and improved bench construction employable in a wide variety of contour designs and sizes of frame configuration without the need for change of slat brackets.

It is to be understood that the term "bench" is used throughout this application in its broadest sense and could also apply to other similar devices such as chairs or lounges or the like.

Achievement of the foregoing objects is enabled by the preferred embodiment of the invention through the provision of at least a pair of spaced transversely aligned metal frame members each including a flat metal base plate normally engageable with the ground or other supporting surface to which an upwardly extending support column is unitarily connected. The upper end of the support column is welded to the lower side of a unitary curved metal frame plate which can be curved or flat having a generally L-shaped configuration including a bottom defining portion, an intermediate connection portion and an upwardly extending relatively straight back portion. A plurality of circular openings are provided along the length of the metal frame plate members for permitting the attachment of slat attachment means defining the bottom and back portions of the bench.

The slat attachment means each comprise an angle member consisting solely of first and second plates oriented perpendicular to each other with one of the plates being provided with a bolt or screw receiving aperture through which a bolt or screw extends through the plate and thence through the supporting metal frame plate. The bolt or screw head is positioned above the angle plate and a slat is received over each bolt or screw head with a countersunk area being provided in the slat to accommodate the space for the bolt or screw head. The side of the slat is engaged with the second plate of the angle member through which a plurality of screw openings are provided for receiving screws extending into the slat; other screw openings are similarly employed. Consequently, the wooden slats are supported along a lower surface by the first plate of the angle member and are supported against pivotal movement with respect to the first plate by engagement with the second plate and the screws embedded in the slat and extending through both the first and second plates. The angle members retaining the slats defining the seat portion of the bench are oriented so that the second plates extending upwardly from the supporting metal framework are all positioned inwardly with respect to the first plate and the forward edge of the seat portion of the bench. In other words, the angle members have their plate components extending outwardly from the supporting plate positioned to be as close as possible to the back portion of the bench. Conversely, the slats in the back portion of the bench are subjected to substantial downward force and the angle members supporting these slats are oriented so that the second or protruding plate of the angle member extends outwardly beneath the sides of the slats so that the normal forces exerted on the slats of the back portion are fully resisted by the second plate of each of the angle members, thus translating stress away from the wood.

A better understanding of the manner in which the preferred embodiment of the invention achieves the foregoing objects will be enabled when the following written description is considered in conjunction with the appended drawings, in which.

Figure 1:
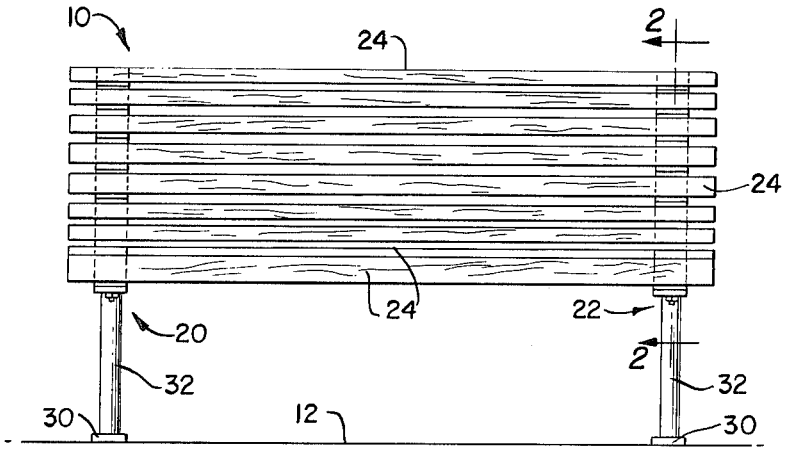
FIG. 1 is a front elevation view of the preferred embodiment.

Attention is initially invited to FIG. 1 of the drawings which illustrates the preferred embodiment of the invention, generally designated 10, which is positioned on a supporting surface 12 such as the earth or the like. The preferred embodiment includes first and second spaced aligned frame members 20 and 22 which provide support for a plurality of wooden slats 24.

Figure 2:
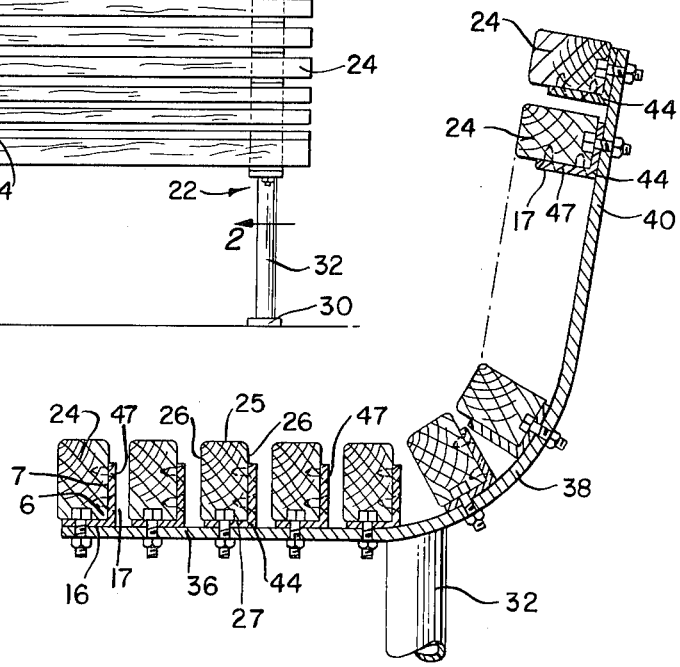
FIG. 2 is a sectional view taken along lines 2—2 of FIG. 1.
Figure 3:
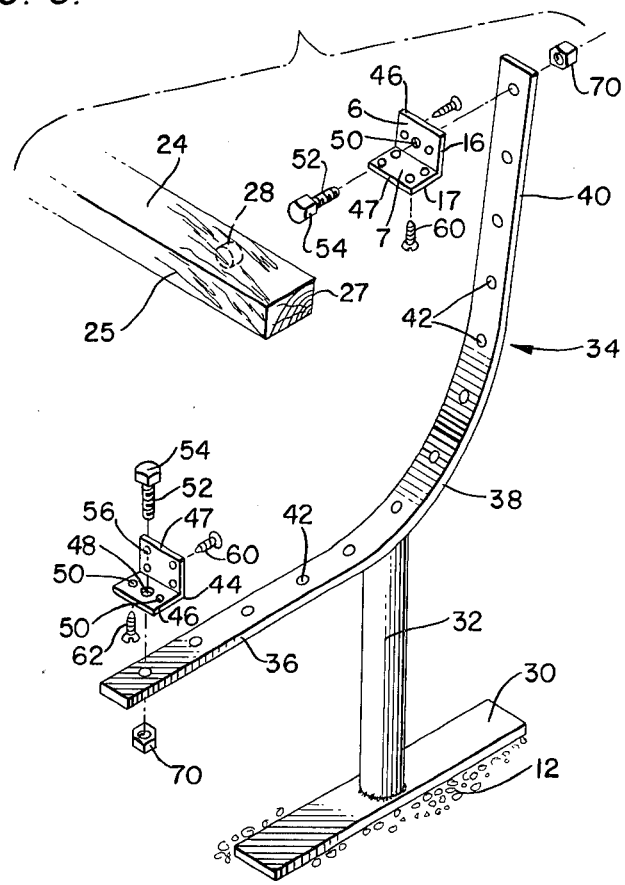
FIG. 3 is an exploded perspective view of the basic components of the preferred embodiment.

Spaced and aligned frame members 20 and 22 are of identical construction which will be better understood with reference to FIGS. 2 and 3 which illustrate frame member 22 and associated slats 24 in detail. Each of the frame members includes a base plate 30 resting on or embedded in the ground or other supporting surface 12. An upwardly extending support column or pipe 32 is welded or otherwise unitarily connected to the base plate 30 and has its upper end welded or mechanically connected to the lower surface of a curved metal frame plate 34 of generally L-shaped configuration. While a curved frame plate is disclosed, it should be understood that a flat frame plate could also be employed. Frame plate 34 includes a horizontal flat seat portion 36, a curved intermediate connecting portion 38 and a vertically extending back portion 40; it should be understood that any change in the bench shape can be effected solely by changing the shape of frame plate 34.

A plurality of bolt receiving openings 42 are provided in the frame plates 34 with each of openings 42 permitting the attachment of a slat mounting angle bracket 44 on the upper surface of the metal frame plate 34. Each of the angle brackets 44 is formed of metal and includes a first plate component 46 having a bolt receiving opening 48 positioned between two screw openings 50. A second plate component 47 includes four screw receiving openings 56. Plate components 46 and 47 respectively have inner surfaces 6 and 7 and outer surfaces 16 and 17.

Each of the slat members 24 comprises an elongated wooden member of rectangular cross-section including a top face 25, two side faces 26 and a bottom face 27 (the terms "top," "side" and "bottom" are applied with respect to the slats used as part of the seat portion of the bench). While the slats 24 illustrated in the preferred embodiment are of rectangular configuration, they could also be of square configuration if desired. In any event, the bottom face 27 of each slat is provided with a countersunk recessed opening 28 dimensioned to snugly receive the head 54 of the mounting bolt 52 with the bolt head being sized to be held by friction without turning in the hole. Screw members 60 extend through the screw receiving openings 56 of the second plate 47 while screw members 62 similarily extend through the openings 50 of the first plate 48 with the screw members being embedded into the body of the slat members 24 so as to hold the slat members in position.

It will be observed from inspection of FIGS. 2 and 3 that the angle members 44 attached to the seat portion 36 of the frame plate 34 are oriented so that the second plates 47 are more closely positioned with respect to the back of the bench than are the first plates 46. This positioning of the second plates 47 resists movement of the slats 24 toward the back of the bench in an obvious manner due to the fact that the sides 26 of the seat forming slats engages the second plate 47. Moreover, downward movement of the slats is resisted by virtue of the fact that the lower face 27 of each slat rests upon the first plate 46. The slats are held in position on the angle members 44 by the screws extending through the screw receiving openings 50 and 56 in the angle brackets. Moreover, the positioning of the bolt head 54 in the countersunk recessed opening 28 is relatively snug so as to provide for a further resistance to lateral movement of the slat members.

It will be observed that the uppermost angle member in the upper portion of the intermediate curved connection portion 38 of the frame plate is reversely oriented from the angle brackets positioned below it and resting on and attached to the seat portion 36 of the frame plate. This positioning is provided so that the second plate 47 of each of the angle brackets provides support against the downward forces commonly exerted upon the slat components of the bench back held by these angle brackets. Specifically, these slat components are subjected to downward force and the second plate engaging the side of the slat resists such downward force without the screw members having to absorb the force to any substantial extent. Consequently, the slat members will be held in position even if the wood shrinks and the screws 60 and 62 will work against each other to hold the slat firmly in position; force exerted on the slat members is always absorbed by the second plate components 47 of the angle brackets through which the screws extend.

Assembly of the bench is effected by positioning the bolt members 52 to extend through the openings 48 in the various brackets 44. The slat members are then connected to the brackets by screw members 60 and 62 and the bolts are passed through the openings 42. Nut members 70 are attached to the lower ends of the bolt members to retain the brackets and their associated slats in position in an obvious manner.

The foregoing construction enables the bench components to be completely disassembled and packed in a remarkably small space for shipment to the eventual user. Assembly of the bench requires only the simplest of tools and can be accomplished by non-skilled labor in an obvious manner with substantial cost savings. Moreover, the basic components can be automatically fabricated with a minimum amount of labor and equipment.

Numerous modifications of the preferred embodiment will undoubtedly occur to those of skill in the art and it should be understood that the spirit and scope of the invention is to be limited solely by the appended claims.

I claim:

1. A bench including first and second spaced and aligned frame means each including a frame plate element of desired configuration, a plurality of angle brackets formed solely of first and second mutually perpendicular plates each having an inner face and an outer face, a plurality of wooden slat members each having a top face, a bottom face and two side faces, bracket attachment means attaching said first plates of said angle brackets to a respective one of said first and second spaced and aligned frame members with each of the outer faces of the first plates engaging the frame member to which it is attached and the brackets on the first frame means being aligned with the brackets on the second frame means with each bracket member having its second plate extending outwardly perpendicularly from the frame means to which it is attached, each of said slat members having its bottom face resting on the inner faces of the first plates of two of said aligned brackets and having a side face abutting against the inner faces of the second plates of the two aligned brackets on which the respective slat is mounted and slat fastener means fastening said slats to said second plates of said brackets.

2. The invention of claim 1 wherein said first plates each have a bolt receiving opening and said bracket attachment means includes a bolt extending through each of said bolt receiving openings in said first bracket plates and nut means received on said bolts on the side of said frame means opposite said first plates.

3. The invention of claim 1 wherein said slat fastener means includes screw members extending through said second plates into said slats, said first plates each include a bolt receiving opening and said bracket attachment means includes a bolt extending through said bolt receiving openings in said first bracket plates and a recess in the bottom face of each of said slats fitted over the head of said bolt.

4. The invention of claim 1 wherein said slat fastener means includes screw members extending through said second plates into said slats, said first plates each include a bolt receiving opening and said bracket attachment means includes a bolt extending through said bolt receiving openings in said first bracket plates and wherein said frame members each have a front end surface terminating adjacent the front edge of the seat portion, a curved connector portion joining the end of said horizontal seat portion to a lower end portion of said upwardly extending back portion with the upwardly extending back portion terminating at an upper end surface.

5. The invention of claim 4 wherein said first plate includes screw receiving openings and said slat fastener means additionally includes screw means embedded in said slat means and extending through said screw receiving openings in said first plate.

6. The invention of claim 1 wherein each of said frame means is of generally L-shaped configuration which includes a horizontal seat portion and an upwardly extending back portion and includes a flat base member resting on a supporting surface and a vertical support column extending upwardly from said base member and having an upper end connected to said flame plate element.

7. The invention of claim 6 wherein said first plates each have a bolt receiving opening and said bracket attachment means includes a bolt extending through each of said bolt receiving openings in said first bracket plates and nut means received on said bolts on the side of said frame means opposite said first plates.

8. The invention of claim 6 wherein said slat fastener means includes screw members extending through said second plates into said slats, said first plates each include a bolt receiving opening and said bracket attachment means includes a bolt extending through said bolt receiving openings in said first bracket plates and a recess in the bottom face of each of said slats fitted over the end of said bolt.

9. The invention of claim 6 wherein said slat fastener means includes screw members extending through said second plates into said slats, said first plates each include a bolt receiving opening and said bracket attachment means includes a bolt extending through said bolt receiving openings in said first bracket plates and wherein said frame members each have a front end surface terminating adjacent the front edge of the seat portion, a curved connector portion joining the end of said horizontal seat portion to a lower end portion of said upwardly extending back portion with the upwardly extending back portion terminating at an upper end surface.

10. The invention of claim 9 wherein said first plate includes screw receiving openings and said slat fastener means additionally includes screw means embedded in said slat means and extending through said screw receiving openings in said first plate.

* * * * *